US008006751B2

(12) United States Patent
Lambert et al.

(10) Patent No.: US 8,006,751 B2
(45) **Date of Patent: *Aug. 30, 2011**

(54) AUTOMATED SYSTEM FOR POSITIONING AND SUPPORTING THE WORK PLATFORM OF A MOBILE WORKOVER AND WELL-SERVICING RIG

(75) Inventors: Jeff A. Lambert, Conroe, TX (US); James C. Garrett, Kingwood, TX (US); Kenneth L. Cambern, Pampa, TX (US); Joel M. Ferland, Pampa, TX (US); Jay D. Furnish, Pampa, TX (US); Donald W. Johnson, Pampa, TX (US); Michael R. Zemanek, Pampa, TX (US); James R. Cirone, Pampa, TX (US); Calvin R. Blankenship, Lindsay, OK (US)

(73) Assignee: National-Oilwell, L.P., Houston, TX (US)

( * ) Notice: Subject to any disclaimer, the term of this patent is extended or adjusted under 35 U.S.C. 154(b) by 990 days.
This patent is subject to a terminal disclaimer.

(21) Appl. No.: 11/973,491

(22) Filed: Oct. 8, 2007

(65) Prior Publication Data

US 2008/0038093 A1 Feb. 14, 2008

Related U.S. Application Data

(63) Continuation-in-part of application No. 11/180,254, filed on Jul. 13, 2005, now Pat. No. 7,293,607.

(60) Provisional application No. 60/588,231, filed on Jul. 15, 2004.

(51) Int. Cl.
*E21B 19/00* (2006.01)

(52) U.S. Cl. ..... 166/75.11; 166/85.1; 414/540

(58) Field of Classification Search ..... 166/379, 166/53, 85.1; 414/540, 541, 544; 248/235, 248/295.11, 297.31, 408; 52/651.01, 651.05, 52/653.1, 143
See application file for complete search history.

(56) References Cited

U.S. PATENT DOCUMENTS 1,366,487 A 1/1921 Pituo
(Continued)

FOREIGN PATENT DOCUMENTS

WO WO 2006/019880 2/2006

OTHER PUBLICATIONS

The PCT International Search Report and the Written Opinion of PCT/US08/78935 mailed Dec. 5, 2008.

(Continued)

*Primary Examiner* — Daniel P Stephenson
(74) *Attorney, Agent, or Firm* — Winston & Strawn LLP

(57) ABSTRACT

A method and apparatus for positioning and supporting the work platform of a mobile workover rig is disclosed. The work platform of the preferred embodiment of the present invention utilizes a unique support structure and automated positioning system for positioning the work platform at the desired height above the wellhead equipment. The preferred embodiment of the present invention utilizes a specialized automated "pinning" system that secures the work platform at the desired height. Additionally, the present invention utilizes one or more support cylinders to position and support the work platform in the horizontal position over the wellhead equipment. The automated positioning and pinning system of the present invention is a unique system that significantly reduces the time required to position the work platform of a mobile workover rig in the operating position, as well as significantly reduces the risk of injury to rig personnel assisting in the positioning operations.

23 Claims, 6 Drawing Sheets

U.S. PATENT DOCUMENTS

| | | | | |
|---|---|---|---|---|
| 2,284,360 | A | 5/1942 | Berby | 187/2 |
| 3,960,360 | A | 6/1976 | Elliston | 166/77 |
| 4,056,203 | A | 11/1977 | Meldahl et al. | 214/75 T |
| 4,071,115 | A | 1/1978 | Garcia | 187/2 |
| 4,251,176 | A | 2/1981 | Sizer et al. | 414/22 |
| 5,385,440 | A | 1/1995 | Raben | 414/608 |
| 5,988,299 | A | 11/1999 | Hansen et al. | 175/52 |
| 6,659,707 | B2 | 12/2003 | Jensen | 414/557 |
| 7,293,607 | B2 * | 11/2007 | Lambert et al. | 166/75.11 |
| 2006/0182581 | A1 | 8/2006 | Murray et al. | 414/541 |

OTHER PUBLICATIONS

The PCT International Search Report and the Written Opinion of PCT/US08/81460 mailed Dec. 23, 2008.

Photographs of working platform with mounting shoes in a lifting track mounted on the back of a Pemco Mast, Nub Sullivan, Jun. 2001, 2 pages.

The PCT International Search Report and The Written Opinion of PCT/US05/24944 mailed Feb. 5, 2007.

* cited by examiner

AUTOMATED SYSTEM FOR POSITIONING AND SUPPORTING THE WORK PLATFORM OF A MOBILE WORKOVER AND WELL-SERVICING RIG

CROSS REFERENCE TO RELATED APPLICATION

This application is a continuation-in-part of U.S. application Ser. No. 11/180,254 filed Jul. 13, 2005 now U.S. Pat. No. 7,293,607, which was a non-provisional application claiming priority to U.S. Provisional Application Ser. No. 60/588,231, entitled, "Automated System for Positioning and Supporting the Work Platform of a Mobile Workover and Well-Servicing Rig," by Jeff A. Lambert et al., filed Jul. 15, 2004, hereby incorporated by reference in its entirety herein.

FIELD OF THE INVENTION

The present invention relates to mobile workover and well-servicing rigs (referred to herein as "workover rigs") particularly useful in the oil and gas industry. In particular, the invention relates to an improved automated system for positioning and supporting the work platform of a mobile workover rig over a wellhead for conducting workover operations. The automated positioning system of the present invention allows the work platform of the workover rig to be raised or lowered to the desired working height, secured at the desired working height, and positioned and supported in the horizontal position over the wellhead in substantially less time—and with less risk of injury to rig personnel—than prior art mobile workover rigs.

BACKGROUND OF THE INVENTION

From time to time, one or more remedial operations may need to be performed on an oil and/or gas well to maintain or increase the well's production. Examples of such remedial operations, or workover operations, include, but are not limited to, replacing downhole pumps, replacing worn tubing, repairing leaking casing, pulling sucker rods, scale and sand removal, acidizing the formation, squeeze cementing, and plugging and abandonment. Many of these workover operations are performed with a workover rig.

A workover rig is typically a transportable, truck mounted, self propelled unit that consists of a hoist or drawworks and an engine mounted to the truck chassis. The rig includes a self-erecting mast that, together with the engine and drawworks, allows the handling, removal, and running of the sucker rods, tubing, or work string into or out of the well bore. A mud pump and associated pits or tanks and related accessories may be used with the rig to circulate wellbore fluids.

When workover operations must be conducted on a well, a mobile workover rig can be driven or otherwise transported to the well site. Operations on a mobile workover rig are conducted from a work platform—a large, typically rectangular platform that is placed and supported in the horizontal position over the wellhead. The work platform is typically mounted to the rear of the truck—opposite from the engine end.

During transportation of the mobile workover rig, the work platform is typically "folded up" such that it is in the substantially vertical position. Depending on the height of the wellhead equipment and the blowout prevention equipment (i.e., the BOP stack) above the well bore, the work platform must either be raised or lowered at the well site to the desired height above such equipment so that workover operations can commence. Once the proper height is obtained, the work platform must be "pinned" to the platform support structure that is attached to the truck.

After pinning the work platform at the desired height, the work platform can be "folded down" until it is in the horizontal position over the wellhead equipment. When in the horizontal position, support structure(s)—such as support legs—may be placed under the outboard side of the platform (i.e., under the area of the platform furthest from the connection point to the truck). Alternatively, wireline and/or chains often referred to as "hang off supports" that are hung from the racking board on the rig's mast may be connected to the outboard side of the platform to help support the platform.

Positioning and supporting the work platform of the workover rig on site has proven to be a relatively dangerous and time-consuming process. Specifically, in prior art mobile workover rigs, the work platform is typically raised and lowered using a winch and wireline/sheave system. When the platform is elevated to the desired height, prior art platforms have heretofore been manually pinned to the platform support structure. To connect the work platform to the platform support structure at the desired operating height requires the rig personnel to align pin holes in the sides of the work platform with pin holes in vertical beams of the support structure. Once aligned properly, the work platform and the support structures must be "pinned" together.

Aligning the pin holes of an extremely large component such as a work platform with pin holes in the support structure can be a difficult, potentially dangerous, and time consuming process. In particular, because the work platform is typically supported by a wireline, the platform is able to "sway"—albeit a limited amount—in both the front-to-back and side-to-side directions. This movement of the platform often makes aligning the pin holes very difficult and potentially dangerous.

Additionally, to pin the work platform to the support structure, it is necessary for one person to hold the pin in place while another person drives the pin through the pin holes with a sledge hammer or other device. This process is repeated until all the pins connecting the work platform to the support structure are driven in place. Given the fact that multiple pins are required to pin the work platform to the support structure, the process of aligning the pin holes and pinning these components together takes a significant amount of time. Moreover, the process of pinning these components together can be dangerous for the rig personnel performing such task.

Further, positioning and supporting the work platform in the horizontal position above the wellhead is also a time consuming and dangerous process. In particular, as noted above, support legs or other support structures must be placed between the underside of the platform and the ground after the platform has been "folded down." In prior art mobile workover rigs, the support "legs" are typically separate support structures that are pinned to the platform and that must be properly placed under the platform. The proper placement of the support legs has heretofore been conducted manually, typically requiring rig personnel to work beneath the platform. Standing beneath the work platform before the support legs are in place is a dangerous situation, however, as the only component supporting the platform in the horizontal position at that point is the wireline. Moreover, in prior art mobile workover rigs, it is difficult to determine when exactly the platform has reached the horizontal position.

Alternatively, if "hang off supports" are used, the wireline and/or chains must be connected to the racking board high up in the rig's mast and then "dropped" so that they can be attached to the work platform. Use of such supports thus requires rig personnel to climb high into the rig's mast, thereby creating a potentially dangerous situation. Additionally, the wireline or chains that run from the racking board to the work platform can potentially be a hindrance to the movement of pipe or other tubing being pulled from or run into the well bore.

As indicated from the above discussion, the positioning and supporting of the work platform of prior art workover rigs is a complex, labor-intensive process that takes a significant amount of time. In today's oil industry, oil companies are becoming increasingly more reluctant to pay for this "rig up" time. Thus, it is becoming more and more critical for the operators of workover rigs to minimize the "down time" associated with positioning workover rigs so that the return on the substantial capital expenditure associated with building these rigs can be maximized. Ensuring an adequate return on such a large investment is secondary, however, to the safety of the personnel working on or around the rigs—as safety is of paramount importance to the rig manufacturers, the rig operators, and the oil companies.

Accordingly, what is needed is a system for positioning and supporting the work platform of a workover rig more efficiently than in prior art workover rigs. It is an object of the present invention to provide an automated method and apparatus for positioning and supporting the work platform of a workover rig in significantly less time—and with reduced risk of injury to rig personnel—than prior art workover rigs. Those and other objectives will become apparent to those of skill in the art from a review of the specification below.

SUMMARY OF THE INVENTION

A method and apparatus for positioning and supporting the work platform of a mobile workover rig is disclosed. The work platform of the preferred embodiment of the present invention utilizes a unique support structure and automated positioning system for positioning the work platform at the desired height above the wellhead equipment. The preferred embodiment of the present invention utilizes a specialized automated "pinning" system that secures the work platform at the desired height. Additionally, the present invention utilizes one or more support cylinders to position and support the work platform in the horizontal position over the wellhead equipment. The automated positioning and pinning system of the present invention is a unique system that significantly reduces the time required to position the work platform of a mobile workover rig in the operating position, as well as significantly reduces the risk of injury to rig personnel assisting in the positioning operations.

Further, the present invention allows for the operators platform, including the operator's controls, of the mobile workover rig to be raised and lowered with the work platform. By maintaining the operators platform at the same level as the work platform, the operator can more efficiently supervise and conduct the workover operations. In addition, maintaining the operators platform at the same level as the work platform helps increase the overall safety of the rig personnel, as the operator can immediately walk from the operators platform to the work platform to assist rig personnel in an emergency (and vice versa). The present invention also increases the efficiency of the operator as the operators platform may be connected to the work platform allowing for more rapid travel between the two platforms.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

FIG. 2 shows the operators platform attached to the work platform structure (as viewed from the work platform).

FIG. 4 also shows the support structure attached to the base section of the workover rig's mast.

FIG. 5 also shows the operators platform connected to the work platform support structure according to one embodiment of the present invention.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 1:
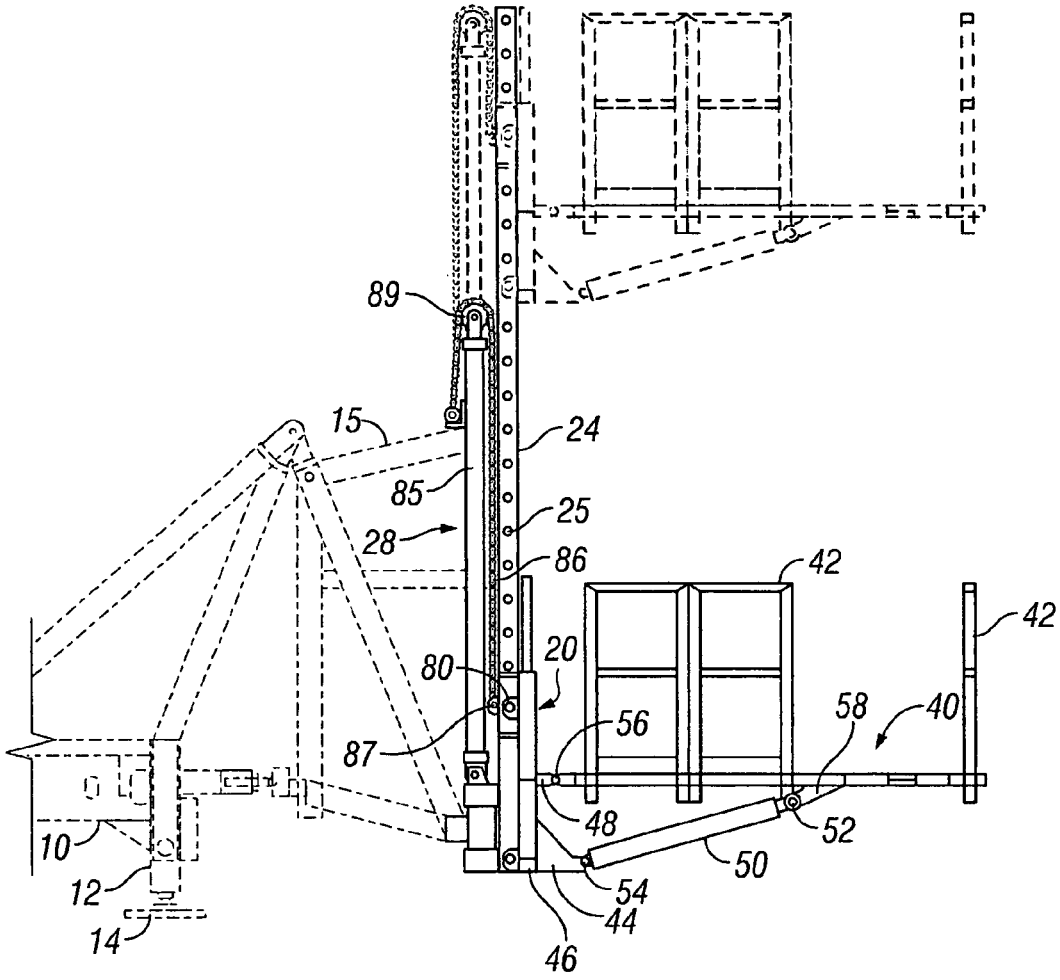
FIG. 1 is a side view of a work platform and support structure for a mobile workover rig with an automated system for positioning and supporting the work platform above a wellhead according to one embodiment of the present invention.

Referring to FIG. 1, an automated positioning and support system for positioning the work platform 40 of a mobile workover rig 10 is shown. FIG. 1 shows the platform end of mobile workover rig 10. Workover rig 10 is a truck-mounted, self-propelled unit that consists of a hoist or drawworks, and an engine mounted to the truck chassis. Workover rig 10 includes a self-erecting mast that, together with the engine and drawworks, allows the handling, removal, and running of the sucker rods, tubing, or work string into or out of the well bore. A mud pump and associated pits or tanks and related accessories may be used with workover rig 10 to circulate wellbore fluids.

FIG. 1 also shows telescoping supports 12 extending downwardly from the underside of workover rig 10. In operation, telescoping supports 12 telescope downwardly until pivoting support pads 14 contact the ground, thereby providing a stabilizing, supporting force for the platform end of workover rig 10. In the preferred embodiment of the present invention, pivoting support pads 14 are capable of pivoting about their connection point to telescoping supports 12 such that they can accommodate reasonably uneven or rocky terrain at the well site.

Figure 2:
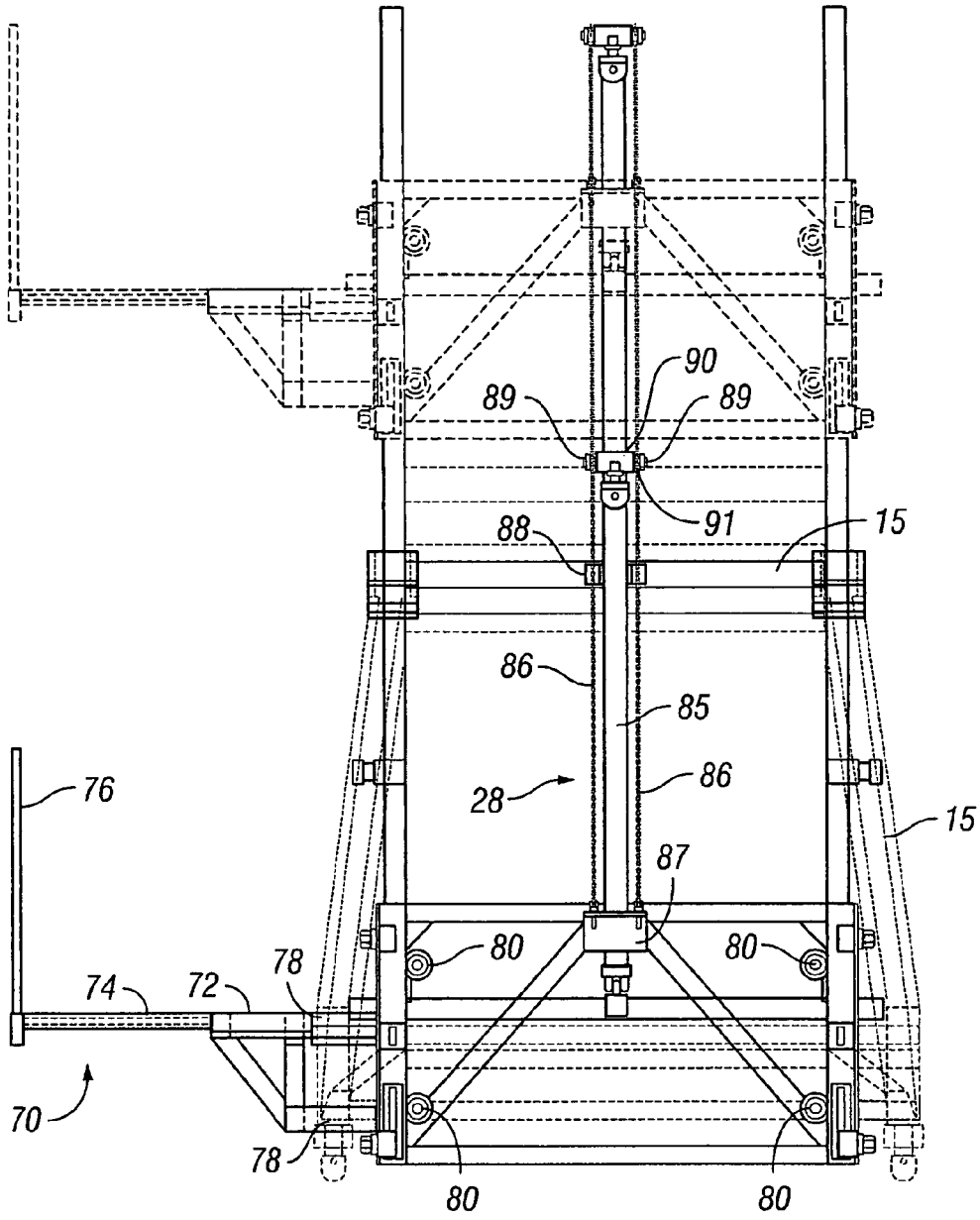
FIG. 2 is an end view of the embodiment shown in FIG. 1.
Figure 4:
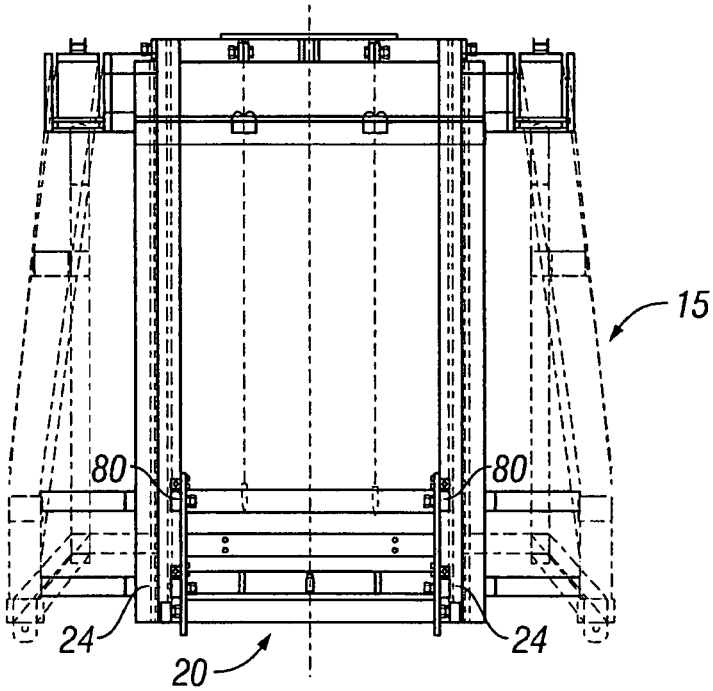
FIG. 4 is an end view of the support structure shown in FIG. 3 viewed along the line A-A shown in FIG. 3.

In accordance with the preferred embodiment of the present invention, FIG. 1 shows strongback structure 20 movably "connected" to vertical support beam 24 through use of a series of rollers 80 (as discussed in more detail with reference to FIGS. 4 through 6). Strongback structure 20 is a unique movable support structure that supports work platform 40. As shown in FIGS. 2 and 4, strongback structure 20 comprises a series of interconnected metal support beams or tubulars that are designed to support the weight of—and the forces generated by the positioning of—work platform 40. One of skill in the art will appreciate that the exact design of strongback structure 20 will depend on numerous factors, including, but not limited to, the size and weight of work platform 40 and the type of lifting mechanism employed to raise and lower work platform 40.

Vertical support beam 24 is attached to the base section 15 of the workover rig's mast (not shown). In the preferred embodiment, vertical support beam 24 is attached to base section 15 by welding. One of skill in the art will appreciate, however, that vertical support beam 24 can be attached to base section 15 through any suitable connection means capable of withstanding the forces imposed on vertical support beam 24 by strongback structure 20. Depending on the range of working heights work platform 40 is designed for, the length of vertical support beam 24 may be such that it is also attached to the lower section of the workover rig's mast.

As seen in FIG. 1, vertical support beam 24 has a series of pin holes 25 extending through it along a substantial portion of its length. Additionally, as discussed in more detail with reference to FIGS. 5 and 6, the cross-sectional shape of vertical support beam 24 is selected such that rollers 80 can roll along vertical support beam 24 when strongback structure 20—and thus work platform 40—is being raised or lowered. In the preferred embodiment of the present invention, vertical support beam 24 is a "T" shaped beam or an "L" shaped beam (as shown in FIGS. 5 and 6). One of ordinary skill in the art having the benefit of this disclosure will appreciate, however, that vertical support beam 24 can be any cross-sectional shape that provides a surface for rollers 80 to roll along and that provides sufficient strength to withstand the forces imposed on it by the rollers 80. Additionally, one of ordinary skill in the art having the benefit of this disclosure will appreciate that the size (the dimensions) of vertical support beam 24 can vary and will depend on numerous factors, including, but not limited to, the size and weight of work platform 40, the lifting mechanism utilized to raise and lower strongback structure 20, and the range of heights at which work platform 40 can be positioned.

FIG. 1 also shows lifting mechanism 28 used for raising and lowering the strongback structure 20. In the preferred embodiment of FIG. 1, the lifting mechanism 28 comprises one or more lifting cylinders 85 (either hydraulically or pneumatically actuated) with sprockets (or sheaves) 89 on top of the lifting cylinders 85. One end of one or more chains 86 is attached to plate 87, which is attached to the strongback structure 20. Alternatively, wirelines could be used in place of chains as would be appreciated by one of ordinary skill in the art having the benefit of this disclosure. The chains 86 are run over the sprockets 89 to an anchoring bracket 88 that is connected to base section 15 of the workover rig's mast. In the preferred embodiment, anchoring bracket 88 fits around lifting cylinder 85 and is welded to base section 15. In such embodiment, as the lifting cylinders 85 extend upwardly, the sprockets 89 rotate causing the chains 86 extending between the strongback structure 20 and the sprocket 89 to raise the strongback structure 20.

Additionally, the dashed portions of FIG. 1 show the lifting cylinder 85 extended with the strongback structure 20 and work platform 40 in a raised position. The height of the strongback structure 20 is limited to the height of the vertical support beam 24, which could be varied according to application as would be appreciated by one of ordinary skill in the art having the benefit of this disclosure.

Figure 3:
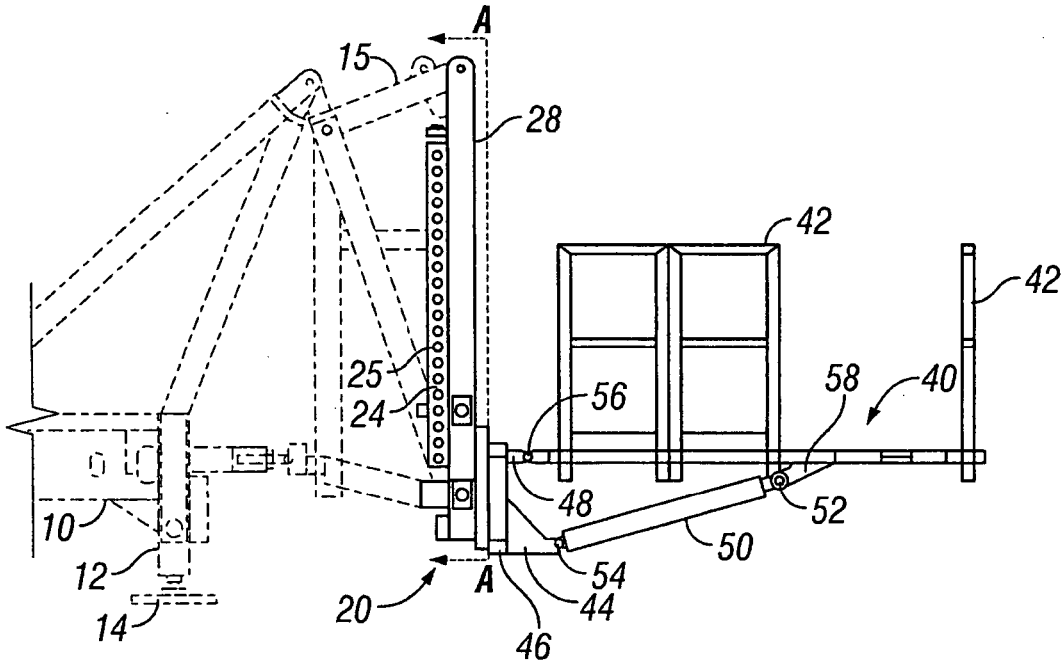
FIG. 3 is a side view of a work platform and support structure for a mobile workover rig with an automated system for positioning and supporting the work platform above a wellhead according to one embodiment of the present invention.

FIG. 3 shows an alternative embodiment of a "forklift style" lifting mechanism 28 used for raising or lowering strongback structure 20. That is, lifting mechanism 28 comprises one or more telescoping members that can telescope upwardly to raise strongback structure 20 (and thus raise work platform 40) or, conversely, can telescope inwardly to lower strongback structure 20 (and thus lower work platform 40). The outer member of the "forklift style" lifting mechanism is stationary and attached directly to base section 15. The inner member (i.e., the member that is raised or lowered) is attached to strongback structure 20. As the inner member is extended, strongback structure 20 is raised; conversely, as the inner member is retracted, strongback structure 20 is lowered. For workover rigs with larger height ranges, additional telescoping members may be required. In such a situation, a second strongback structure 20 may be attached to a third telescoping member. As with a forklift, the telescoping members of lifting mechanism 28 are actuated by hydraulic (or, depending on the size of work platform 40, pneumatic) cylinders.

One of ordinary skill in the art having the benefit of this disclosure will appreciate that alternative lifting mechanisms may be utilized to raise or lower strongback structure 20 (and thus raise or lower work platform 40) without departing from the scope of the present invention. For example, a standard winch/wireline system may be utilized.

In another alternative embodiment, lifting mechanism 28 may comprise a "rack and pinion" system. In such embodiment, gear teeth are integrally formed on (or welded to) vertical support beam 24 to form the "rack." One or more motor driven pinion gears—i.e., the "pinions"—are mounted on strongback structure 20 such that the teeth of the pinion gears "mesh" with the teeth of the rack to raise or lower strongback structure 20 according to the direction of rotation of the pinions. The pinion motors may be provided with a braking system to maintain strongback structure 20—and thus work platform 40—at the desired height.

As shown in FIG. 3, strongback structure 20 may include vertical support 46. Extending outwardly from vertical support 46 are horizontal support plates 44 and 48. In the embodiment shown in FIG. 3, horizontal support plates 44 and 48 are welded to vertical support 46. One of ordinary skill in the art having benefit of this disclosure will appreciate, however, that horizontal support plates 44 and 48 can be attached to vertical support 46 by any suitable connecting means that is capable of withstanding the forces imposed on the horizontal supports by the weight and movement of work platform 40.

As shown in FIG. 3, horizontal support plates 44 and 48 include pin connectors 54 and 56 respectively that are integrally formed in (or attached to) support plates 44 and 48. Pin connector 56 of horizontal support plate 48 is used to connect support plate 48 to work platform 40.

In one embodiment, pin connector 54 of horizontal support plate 44 is connected to a unique support cylinder 50. On its opposite end, support cylinder 50 is connected to work platform 40 via pin connector 52 that is integrally formed in (or attached to) support plate 58. In one embodiment, support plate 58 is welded to work platform 40. Again, however, one of ordinary skill in the art having the benefit of this disclosure will appreciate that support plate 58 can be attached to work platform 40 by any suitable connecting means that is capable of withstanding the forces imposed on the support plate by the weight and movement of work platform 40.

As noted, the connectors for connecting work platform 40 to horizontal support plate 48 and to support cylinder 50, as well as the connectors for connecting support cylinder 50 to horizontal support plate 44, are pin type connectors in one embodiment of the present invention. Such connectors allow work platform 40 to "pivot" or rotate about its connection points to horizontal support plate 48 and to support cylinder 50 in the vertical direction. Similarly, pin connector 54 between horizontal support plate 44 and support cylinder 50 allows support cylinder 50 to "pivot" or rotate in the vertical direction. Although these connectors are pin-type connectors in one embodiment of the present invention, one of ordinary skill in the art having the benefit of this disclosure will appreciate that these connectors can be any suitable connection means that allows work platform 40 and support cylinder 50 to "pivot" or rotate in the vertical direction and that can withstand the forces imposed on the connectors by the weight and movement of work platform 40.

FIGS. 1 and 3 show the work platform 40 in the horizontal operational position. When workover rig 10 is not in use, however, the work platform 40 will be "folded up" toward lifting mechanism 28 such that the work platform 40 is in a substantially vertical position during transport and storage. In this position, the end of support cylinder 50 that is connected to pin connector 52 is fully extended to support and maintain work platform 40 in the substantially vertical position.

When workover rig 10 reaches a well site, it is positioned such that work platform 40 can be "folded down" and placed in the horizontal operating position above the wellhead equipment. Prior to placing work platform 40 in the horizontal position, lifting mechanism 28 is used to raise or lower strongback structure 20 such that work platform 40 is positioned at the desired working height above the wellhead equipment and, as discussed in more detail with respect to FIG. 7, the automatic pinning mechanism of the present invention secures strongback structure 20 at the desired working height.

To place work platform 40 in the horizontal position, support cylinder 50 retracts, and work platform 40 "pivots" downwardly about pin connectors 56 and 52, while at the same time support cylinder 50 "pivots" downwardly about pin connector 54. Support cylinder 50 continues to retract until work platform 40 reaches the horizontal position shown in FIGS. 1 and 3. To prevent work platform 40 from rotating past the horizontal position, support cylinder 50 is specially designed to "bottom out" when work platform 40 reaches the horizontal position. Support cylinder 50 thereby prevents further rotation of work platform 40 and supports work platform 40 in the horizontal position so that workover operations can be conducted. If the specific operations being conducted on work platform 40 require it, additional supports (such as "leg" supports") may be utilized beneath work platform 40. Of course, the placement of such supports can be done much more safely in light of support cylinder 50 of the present invention.

Although only one support cylinder is shown in the side view of FIGS. 1 and 3, the preferred embodiment of the present invention utilizes two spaced apart support cylinders 50 connected between strongback structure 20 and work platform 40. One of ordinary skill in the art having the benefit of this disclosure will recognize, however, that the number of support cylinders used to position and support the work platform may vary depending on the size of the work platform. A total of one support cylinder may be sufficient for positioning and supporting smaller work platforms, while more than two support cylinders may be required for larger work platforms.

FIG. 2 shows and end view of the strongback structure 20 and base section 15 as viewed from the work platform (not pictured). Rollers 80 are attached to the strongback structure 20 such that the rollers 80 hold the strongback structure 20 against the vertical support beam 24 while the rollers 80 move along the vertical support beam 24. The embodiment of FIG. 2 includes a lifting mechanism 28 comprised of a lifting cylinder 85, chains 86, and sprockets 89. One end of the chains 86 it attached to plate 87, which is connected to the strongback structure 20. The chains 86 are then run over the sprockets 89 and the other end is connected to bracket 88. The bracket 88 may be welded to base section 15. However, one of ordinary skill in the art having benefit of this disclosure would appreciate that the bracket 88 could be connected to the base section by other means. The sprockets 89 are connected to sprocket bracket 90, which is connected to the top of the lifting cylinder 85 by lug 91. As the lifting cylinder 85 extends, the rotation of sprockets 89 increases the length of chain between the sprockets 89 and the bracket 88 while decreasing the length of chain between the sprockets 89 and the plate 87. Thus, the movement of the chains raises the strongback structure 20 and any platform connected to it, such as the work platform (not shown) and the operators platform 70 (discussed in more detail in reference to FIG. 8). Although FIG. 2 only shows one lifting cylinder with two sprockets and two chains, the number and configuration of lifting cylinders, sprockets, and chains could be varied according to application as would be obvious to one of ordinary skill in the art having the benefit of this disclosure. Additionally, the dashed portions of FIG. 2 show the lifting cylinder 85 extended with the strongback structure 20 and operators platform 70 in a raised position.

Referring to FIG. 4, an end view of strongback structure 20 and base section 15 are shown viewed along the line A-A of FIG. 3. FIG. 4 also shows two vertical support beams 24 that provide the support for and the "track" upon which strongback structure 20 rolls in order to raise or lower work platform 40 (not shown) in the preferred embodiment. One of skill in the art will appreciate that more than two vertical support beams 24 may be used without departing from the scope of the present invention, as more than two vertical support beams 24 may be required for supporting and securing larger work platforms. Alternatively, one of skill in the art will appreciate that for smaller, lighter work platforms, one vertical support beam 24 could be used to support the work platform. Additionally, one of skill in the art will appreciate that the support beams need not be vertical to provide the "track" upon which strongback structure 20 rolls, as the support beams could be tilted or slightly diagonally running and still provide such a track.

Moreover, one of skill in the art will appreciate that more than one strongback structure 20 may be utilized in embodiments using more than two vertical support beams 24. FIG. 4 further shows rollers 80 of strongback structure 20 in contact with vertical support beams 24.

Figure 5:
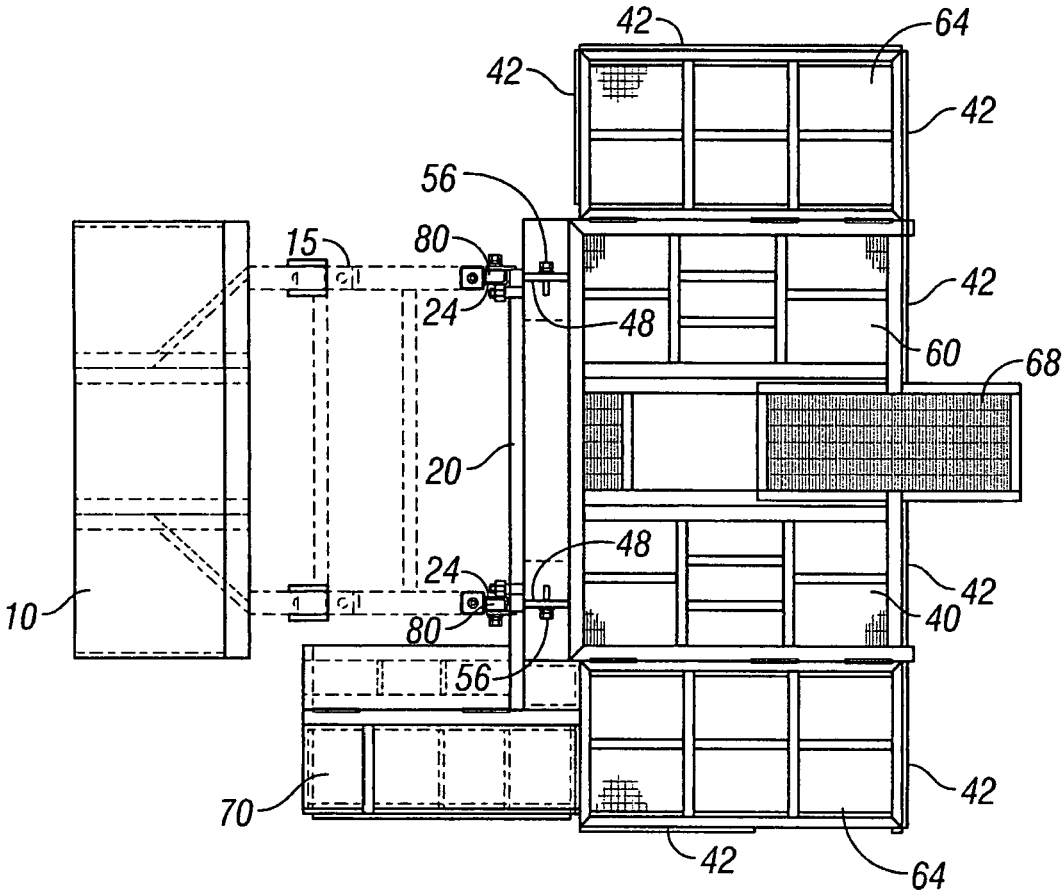
FIG. 5 is a top view of a work platform and support structure for a mobile workover rig according to one embodiment of the present invention.

Referring to FIG. 5, a top view of strongback structure 20 and work platform 40 is shown. As can be seen in FIG. 5, strongback structure 20 is connected between base section 15 and work platform 40. FIG. 5 shows the pin connectors 56 connecting work platform 40 to horizontal support plates 48 in more detail.

FIG. 5 also shows work platform 40 in more detail. As shown in FIG. 5, work platform 40 consists of three sections—main section 60 and two side sections 64—in the preferred embodiment. Side sections 64 are hingedly connected to main section 60 such that side sections 64 can be rotated about the hinges and can be laid flat upon main section 60 during transport and/or storage of workover rig 10. FIG. 5 also shows guard rails 42 positioned about each section of work platform 40 for safety purposes (as can also be seen in the side view of work platform 40 shown in FIGS. 1 and 3).

Sliding segment 68 is an integral part of main section 60 of work platform 40. As shown in FIG. 5, sliding segment 68 slides outwardly to allow access to the wellhead equipment below work platform 40 so that workover operations can be conducted from work platform 40.

Although the preferred embodiment of work platform 40 shown in FIG. 5 is a three section platform with a sliding segment in the center of the platform, one of ordinary skill in the art having the benefit of this disclosure will appreciate that various designs and configurations for work platform 40 can be used without departing from the scope of the present invention. The size, layout, and structural components of work platform 40 will vary depending on numerous factors, including, but not limited to, the applications for which the mobile workover rig is specifically intended and the size of the mobile workover rig.

FIG. 5 also shows operators platform 70 attached to strongback structure 20. As noted above, operators platform 70 is attached to strongback structure 20 in the preferred embodiment such that operators platform 70—as well as the operator's controls—can be raised or lowered along with work platform 40. The connection of operators platform 70 to work platform 40 is shown in more detail and is discussed below with reference to FIGS. 8 and 9.

FIG. 5 further shows rollers 80 of strongback structure 20 positioned about vertical support beams 24. As discussed above with reference to FIG. 1, rollers 80 are designed to roll along portions of vertical support beams 24 when lifting mechanism 28 is actuated to raise or lower strongback structure 20 (and thus work platform 40). The positioning of rollers 80 about vertical support beams 24 is shown in more detail in FIG. 6.

Figure 6:
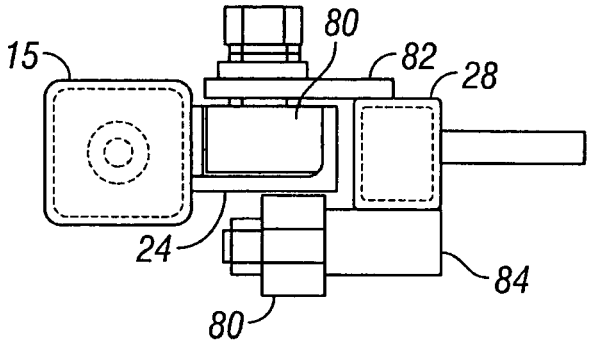
FIG. 6 is a detailed view of a portion of the rollers of the support structure (as shown in FIG. 5) used in the automated positioning of the work platform according to one embodiment of the present invention.

As can be seen in FIG. 6, vertical support beam 24 is attached to base section 15. In the embodiment shown in FIG. 6, vertical support beam 24 has an "L" shaped cross-section. Rollers 80 are attached to strongback structure 20 via roller support plates 82 and 84 so that rollers 80 can press against and roll along the flat surfaces of vertical support beam 24. In the preferred embodiment, roller support plates 82 and 84 are welded to strongback structure 20. Again, however, one of skill in the art will appreciate that roller support plates 82 and 84 can be attached to strongback structure 20 by any suitable connecting means that is capable of withstanding the forces imposed on the support plates.

As shown in FIG. 6, the load carrying surfaces of rollers 80 are at a 90-degree angle to each other when an "L" shaped (or "U" shaped) cross-section is used for vertical support beam 24. By using rollers 80 in this configuration, the rollers 80 are able to stabilize strongback structure 20 against movement in both the front-to-back and side-to-side directions as strongback structure 20 moves up or down vertical support beams 24. By limiting the movement of strongback structure 20 to only the up and down directions, the rollers 80 keep strongback structure 20 (and thus the work platform 40) properly positioned and ensure that the entire strongback structure 20 is raised at the same rate, thereby helping to properly align the pinholes of strongback structure 20 with the pin holes along vertical support beams 24.

Additionally, although not shown in FIG. 6, multiple rollers can be attached to the vertical support members of strongback structure 20 such that strongback structure 20 is "connected" to each vertical support beam 24 at multiple locations. Use of multiple rollers spaced apart in the vertical direction along vertical support beams 24 helps ensure that strongback structure 20 is properly supported and helps ensure that strongback structure 20 rolls smoothly along vertical support beams 24. Alternatively, one of skill in the art will appreciate that for smaller, lighter work platforms utilizing only one support beam, one large roller could be attached to the support beam and still allow strongback structure 20 to roll along the support beam as discussed herein.

Further, although not shown in FIG. 6, the pin holes of strongback structure 20 are formed in (or otherwise connected to) roller support plates 82 and 84 or separate support plates attached to strongback structure 20 either above or below rollers 80.

Figure 7:
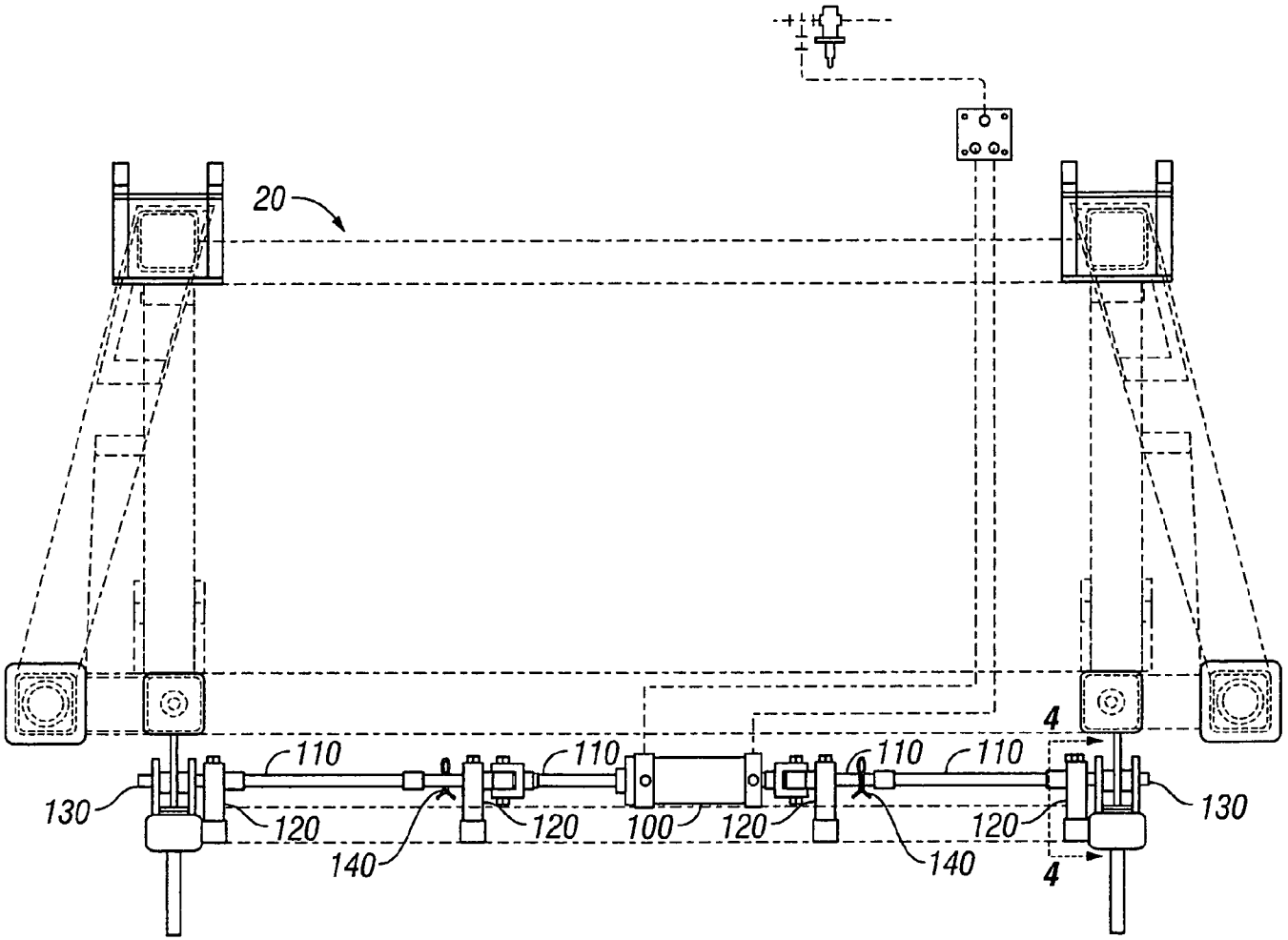
FIG. 7 is a top view of the automated pinning mechanism used to pin the work platform movable support structure to a stationary vertical support beam when the work platform is positioned at the desired height above the wellhead equipment in accordance with one embodiment of the present invention.

Once strongback structure 20 is raised or lowered to the desired height, the unique automated pinning system of the present invention is used to "pin"—and thus secure—the strongback structure 20 at the desired height. Specifically, as shown in FIG. 7, the preferred embodiment of the automated pinning system comprises cylinder 100, cylinder rods 110, rod guides 120, pins 130, and safety pin locks 140. In operation, when work platform 40 is being raised or lowered, cylinder rods 110 are in the retracted position, and pins 130 are not extended through the pin holes of strongback structure 20 and vertical support beams 24. After work platform 40 has been raised or lowered to the desired working height, the pin holes in strongback structure 20 and the pin holes in vertical support beams 24 are aligned. Cylinder 100 is then actuated, forcing cylinder rods 110 to extend in both directions through the aligned pin holes. Rod guides 120 support cylinder rods 110 and maintain cylinder rods 110 and pins 130 in proper alignment such that pins 130 will pass through the aligned pin holes. Once pins 130 have properly engaged the aligned pin holes of strongback structure 20 and vertical support beams 24, safety pin locks 140 are placed through cylinder rods 110 to prevent cylinder rods 110 from prematurely retracting. The use of safety pin locks 140 ensures that pins 130 will not be removed from the aligned pin holes until the rig operator is ready to raise or lower work platform 40.

Although FIG. 7 shows one automated pinning system in the preferred embodiment, one of ordinary skill in the art having the benefit of this disclosure will appreciate that two or more automated pinning systems could be utilized to ensure proper support for and securing of the strongback structure and the work platform at the desired working height and to provide redundancy for the automated pinning system. Additionally, one of ordinary skill in the art having benefit of this disclosure will appreciate that cylinder 100 can be pneumatically, hydraulically, or electrically actuated depending on several factors, including, but not limited to, the power supply available and the operator's preference. Further, one of ordinary skill in the art having benefit of this disclosure will appreciate that the automated pinning system may use automated mechanical means (such as a spring biased means or a cam system) in lieu of cylinder 100 to force pins 130 through the aligned pin holes of strongback structure 20 and vertical support beams 24. Moreover, one of skill in the art having the benefit of this disclosure will appreciate that the strongback structure 20 of the present invention can be secured or "locked" at the desired height via a "ratchet" type system in lieu of using pin holes.

Figure 8:
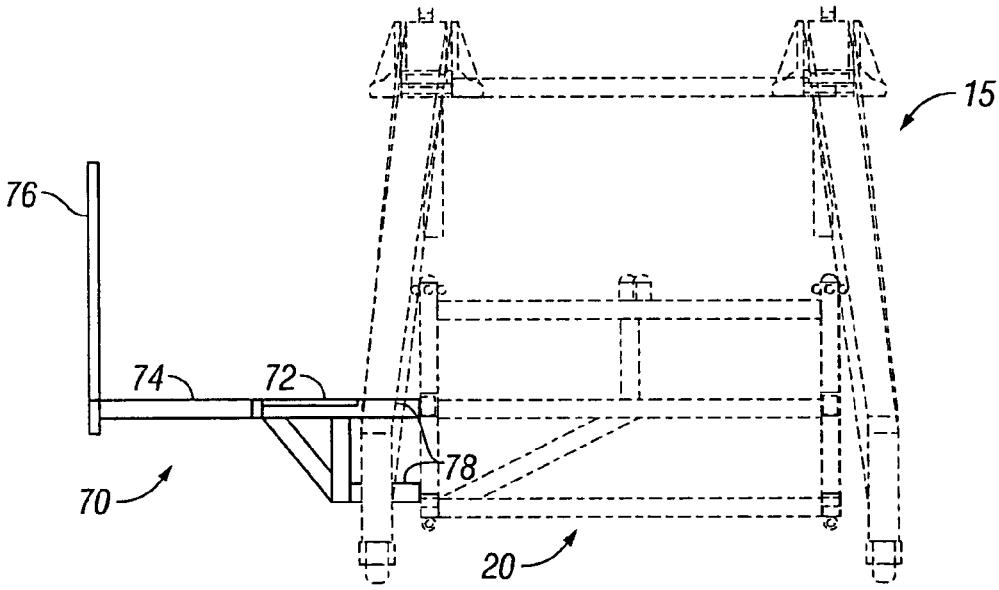
FIG. 8 is an end view of the operators platform attached to the work platform support structure (as viewed from the work platform) according to one embodiment of the present invention.
Figure 9:
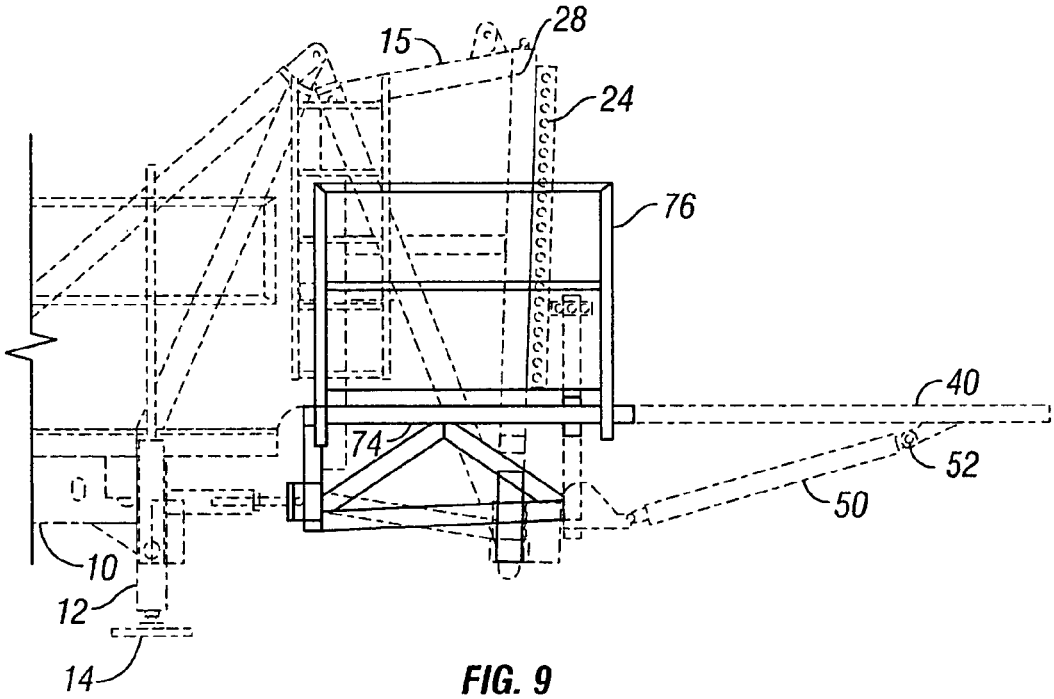
FIG. 9 is a side view of the operators platform attached to the work platform support structure according to one embodiment of the present invention.

Referring now to FIGS. 8 and 9, an operators platform 70 is shown connected to strongback support 20 according to the preferred embodiment of the present invention. In prior art workover rigs, the operators platform and operator's controls were typically not capable of moving up or down with the work platform as the platform was raised. Typically, in such prior art rigs, the operator had one or two options for the placement of the operators platform. This limited the operator's ability to view and supervise operations on the work platform. For example, if the work platform was raised to a level above the operators platform, the operator's view of operations on the work platform would be substantially obstructed by the bottom of the work platform as the operator looked up. The present invention solves this limitation in prior art mobile workover rigs and enhances the safety of rig personnel conducting workover operations on such rigs.

As shown in FIGS. 8 and 9, operators platform 70 is attached to strong back structure 20 in the preferred embodiment of the present invention. As can be seen in FIG. 8, operators platform 70 comprises an inner platform section 72 that is directly connected to strongback structure 20 and an outer platform section 74 that is pivotally connected to inner platform section 72. During transport and/or storage of the workover rig 10, outer platform section 74 can be "pivoted" upward about its connection point to inner platform section 72 until it is perpendicular to platform section 72. In such position, outer platform section 74 provides a level of protection for the operator's control box or panel (mounted on operators platform 70) during transport and storage. FIG. 8 also shows guard rail 76 connected to and placed about outer platform section 74 for safety purposes.

FIG. 8 further shows horizontal support members 78 that are used to connect operators platform 70 to strongback structure 20. By connecting operators platform 70 directly to strongback structure 20, operators platform 70 as well as the operator's controls will move up and down with work platform 40 as strongback structure 20 is raised or lowered. In this way, operators platform 70 can be maintained at the same height as work platform 40. However, in alternative embodiments of the present invention, the operators platform 70 is not connected to the strongback structure 20, but may be connected to the rig 10, for example.

In the preferred embodiment, the operator's controls are housed within a control panel or control box that is mounted directly to operators platform 70. Alternatively, the control panel or control box may be connected directly to strongback structure 20.

FIG. 9 shows a side view of operators platform 70 connected to strongback structure 20. FIG. 9 also shows the support elements underlying operators platform 70 that provide a rigid structural support for the platform. One of ordinary skill in the art having benefit of this disclosure will appreciate that the exact configuration of the support structure for operators platform 70 and the connection of operators platform 70 to strongback structure 20 can vary without departing from the scope of the present invention. The support structure for operators platform 70 will vary depending on several factors, including, but not limited to, the dimensions of operators platform 70, the weight of the platform, and the location of additional equipment on or about the rig.

Additionally, although not shown in FIGS. 8 and 9, the preferred embodiment of the present invention utilizes telescoping stairs that extend from the operators platform 70 to the workover rig 10. When the operators platform 70 is at the height of the workover rig 10, the telescoping stairs are fully retracted. As the operators platform 70 is elevated above workover rig 10, the telescoping stairs "telescope" outwardly to maintain a constant stairway connection between the operators platform 70 and the workover rig 10.

In a similar fashion, telescoping stairs may also be provided on work platform 40. The use of telescoping stairs allows for a constant stairway connection between work platform 40 and the ground despite the raising (or lowering) of work platform 40.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

The invention claimed is:

1. An automated system for positioning and supporting a work platform of a mobile rig comprising:

one or more support beams connected to the mobile rig, at least one of the one or more support beams having a plurality of pin holes;

a movable support structure comprising interconnected support members and one or more support rollers, the movable support structure movably connected to the one or more support beams by the one or more support rollers;

a work platform movably connected to the mobile rig by the movable support structure;

a lifting mechanism for raising or lowering the movable support structure;

at least one support cylinder for positioning and supporting the work platform;

at least one automated pinning system for pinning the movable support structure at a desired height along the one or more support beams.

2. The apparatus of claim 1 wherein the at least one support cylinder is designed to be fully retracted when the work platform is in a horizontal position.

3. The apparatus of claim 1 wherein the one or more support beams are connected to a base section of a drilling mast of the mobile rig.

4. The apparatus of claim 1 wherein the cross-sectional shape of the one or more support beams is selected such that the one or more support rollers can roll along the vertical support beams when the movable support structure is raised or lowered.

5. The apparatus of claim 1 wherein the automated pinning system comprises a cylinder, a cylinder rod, at least one cylinder rod guide, at least one support pin, and at least one support pin lock.

6. The apparatus of claim 5 wherein the automated pinning system is designed to extend a support pin through one of the plurality of pin holes of the one or more support beams.

7. The apparatus of claim 1 wherein the automated pinning system comprises a spring-biased mechanical actuator, at least one pin rod, at least one pin rod guide, at least one support pin, and at least one support pin lock.

8. The apparatus of claim 1 wherein the automated pinning system comprises a cam actuator, at least one pin rod, at least one pin rod guide, at least one support pin, and at least one support pin lock.

9. The apparatus of claim 1 wherein the lifting mechanism comprises a plurality of telescoping members.

10. The apparatus of claim 1 wherein the lifting mechanism comprises a winch mounted to the mobile rig and a wireline connected to the movable support structure.

11. The apparatus of claim 1 wherein the lifting mechanism comprises one or more lifting cylinders, a sheave positioned on each of the one or more lifting cylinders, and a wireline extending from an anchoring point on the mobile rig over the sheaves to a connection point on the movable support structure.

12. The apparatus of claim 1 wherein the lifting mechanism comprises gear teeth on the one or more support beams and at least one pinion gear connected to the movable support structure such that teeth on the at least one pinion gear engage the teeth on the one or more support beams to raise or lower the movable support structure according to the direction of rotation of the at least one pinion gear.

13. The apparatus of claim 12, wherein the at least one pinion gear is actuated by at least one pinion motor.

14. The apparatus of claim 1, wherein the work platform comprises a plurality of platform sections hingedly connected together and wherein one of the plurality of platform sections includes a sliding segment that can be moved to allow access to wellhead equipment below the work platform.

15. The apparatus of claim 1 further comprising an operators platform connected to the movable support structure.

16. The apparatus of claim 15, wherein the operators platform comprises an inner platform section that is connected to the movable support structure and an outer platform section that is pivotally connected to the inner platform section.

17. A method of positioning and supporting a work platform of a mobile rig at a drilling site comprising:

connecting one or more support beams to a drilling mast of the mobile rig, wherein one or more of the one or more support beams have a plurality of pin holes;

connecting a movable support structure to the one or more support beams by one or more support rollers, whereby the one or more support rollers are designed to roll along the one or more support beams such that pin holes on the movable support structure can be aligned with the pin holes on the one or more support beams at a desired height;

movably connecting a work platform to the mobile rig by the movable support structure;

providing a lifting mechanism for raising or lowering the movable support structure;

connecting one or more support cylinders to the movable support structure on one end and to the work platform on an opposite end;

providing one or more automated pinning systems for pinning the movable support structure at a desired height along the one or more support beams;

positioning the mobile rig at the drilling site;

actuating the lifting mechanism to position the movable support structure at a desired height;

actuating the one or more automated pinning systems to pin the movable support structure at the desired height;

actuating the one or more support cylinders to pivot the work platform downwardly to a horizontal position above the drilling site.

18. The method of claim 17 further comprising providing the one or more support beams with a cross-sectional shape that allows the one or more support rollers to roll along the one or more support beams when the movable support structure is raised or lowered.

19. The method of claim 17 further comprising configuring the one or more support rollers such that they stabilize the movable support structure against movement in the front-to-back and side-to-side directions as the movable support structure moves up or down the one or more support beams.

20. The method of claim 17 further comprising connecting an operators platform to the movable support structure by one or more support beams.

21. The method of claim 20 further comprising constructing the operators platform such that an inner platform section is directly connected to the movable support structure and an outer platform section is pivotally connected to the inner platform section.

22. The method of claim 21 further comprising housing operators controls within a control panel that is connected to the operators platform.

23. The method of claim 21 further comprising housing operators controls within a control panel that is connected directly to the movable support structure.

* * * * *